United States Patent [19]

Wang

[11] Patent Number: 4,939,880

[45] Date of Patent: Jul. 10, 1990

[54] MODULAR CONSTRUCTION UNIT

[76] Inventor: Wen-Ping Wang, 39, Chung Shan Rd., Sec. 2, Kong Kuan Village, Hu-Ne Hsiang, Kaohsiung Hsien, Taiwan

[21] Appl. No.: 244,491

[22] Filed: Sep. 14, 1988

[51] Int. Cl.[5] ..... E06B 7/08

[52] U.S. Cl. ..... 52/473; 52/455

[58] Field of Search ..... 52/473, 455, 457, 456; 211/87, 189; 312/297

[56] References Cited

U.S. PATENT DOCUMENTS

| | | | |
|---|---|---|---|
| 2,807,062 | 9/1957 | Sikkema et al. | 52/473 |
| 2,840,870 | 7/1958 | Pohlman | 52/473 |
| 2,847,730 | 8/1958 | Warwick | 52/473 |
| 3,394,518 | 7/1968 | Worrell, Jr. | 52/473 |
| 3,638,383 | 2/1972 | Escudero Ribas | 52/473 |
| 3,691,687 | 9/1972 | Economou | 52/473 |
| 3,968,738 | 7/1976 | Matzke | 52/473 |
| 3,991,533 | 11/1976 | Nagase | 52/473 |

FOREIGN PATENT DOCUMENTS

| | | | |
|---|---|---|---|
| 2253908 | 7/1975 | France | 52/473 |

*Primary Examiner*—Michael Safavi
*Attorney, Agent, or Firm*—Lyon & Lyon

[57] ABSTRACT

A modular construction unit includes: a pair of supporting columns, each having a U-shaped open trough vertically formed in one side; a plurality of scarfing blocks, each having at least one scarfing slot formed in one side, provided in conjunction with the U-shaped open trough for being detachably inserted therein; a plurality of junction blocks which are formed similarly to the scarfing blocks, each having a plurality of threaded holes and scarfing slots provided in one side for being movably inserted in the U-shaped open trough along with the scarfing blocks; a plurality of scarfing members and intermediate beams respectively provided in conjunction with the scarfing slots and the threaded holes of the scarfing blocks and junction blocks for being respectively connected therewith between the supporting columns; so that, with different scarfing blocks and scarfing members, various patterns of assembly for partioned screens and door plates can be made without changing the supporting columns.

6 Claims, 5 Drawing Sheets

MODULAR CONSTRUCTION UNIT

BACKGROUND OF THE INVENTION

This invention relates to a modular construction unit by which various combinations of partitioned screens, door plates and other similar articles can be made.

As shown in FIG. 1, the known modular construction units used to make combinations for partitioned screens, door plates, etc., are made of wooden blocks including composed of a pair of elongated square posts 11, a plurality of scarfing members 13 and intermediate struts 14. Each one of the square posts includes a plurality of scarfing slots 12 formed slantwise on one side so that they may be symmetrically coupled with the scarfing members 13 and respectively inserted in the scarfing slots 11 at both ends so as to form a screen with the intermediate struts 14 fixed at proper locations between the two square posts 11 firmly supporting the combined screen. Problems suffered by the known modular construction units are as follows:

(a) The manufacturing cost is high and the supply of raw material (wood) can hardly meet the constant demand.

(b) Final finishing work, such as painting, has to be done before the item is ready for the market.

(c) Some carpentry equipment has to be provided for accomplishing the combined products.

In addition to the above-mentioned problems, a major defect of the prior art is that the scarfing slots 12 provided in the square posts 11 cannot be altered to make any pattern change unless the square posts 11 are in turn changed to provide for the required scarfing slots. Therefore, the prior art often causes much inconvenience as well as incurring both waste of material and money.

SUMMARY OF THE INVENTION

It is accordingly a primary object of the present invention to provide a modular construction unit that overcomes the problems and defects associated with the prior art.

This and other objects of the present invention are achieved by providing a modular construction unit which comprises: a pair of supporting columns, which can be made of PVC material with an outer surface processed in a simulated wood color with streaks, each having a U-shaped open trough vertically provided on one side; a plurality of scarfing blocks, each having scarfing means formed in one side, provided in conjunction with the U-shaped open trough for being movably and successively inserted into the U-shaped open trough of the supporting columns; a plurality of junction blocks which are formed similarly to the scarfing blocks with a plurality of threaded holes and scarfing means provided in one side for being movably inserted into the U-shaped open trough either on top or at the bottom of one of the inserted scarfing blocks; a plurality of scarfing members provided in conjunction with the scarfing means of the scarfing blocks for being horizontally inserted into the scarfing means at both ends between the two supporting columns which are positioned at opposite directions; and a plurality of intermediate beams, each having a horizontal open trough separately formed in the upper and lower sides for being horizontally secured to the junction blocks at both ends between the two supporting columns; thereby, various combinations can be constructed as desired without changing the supporting columns.

BRIEF DESCRIPTION OF THE DRAWINGS

Other advantages and characteristics of the present invention will become apparent from the following detailed description of a preferred embodiment when read in conjunction with the accompanying drawings, in which.

DETAILED DESCRIPTION OF THE PREFERRED EMBODIMENT

Figure 1:
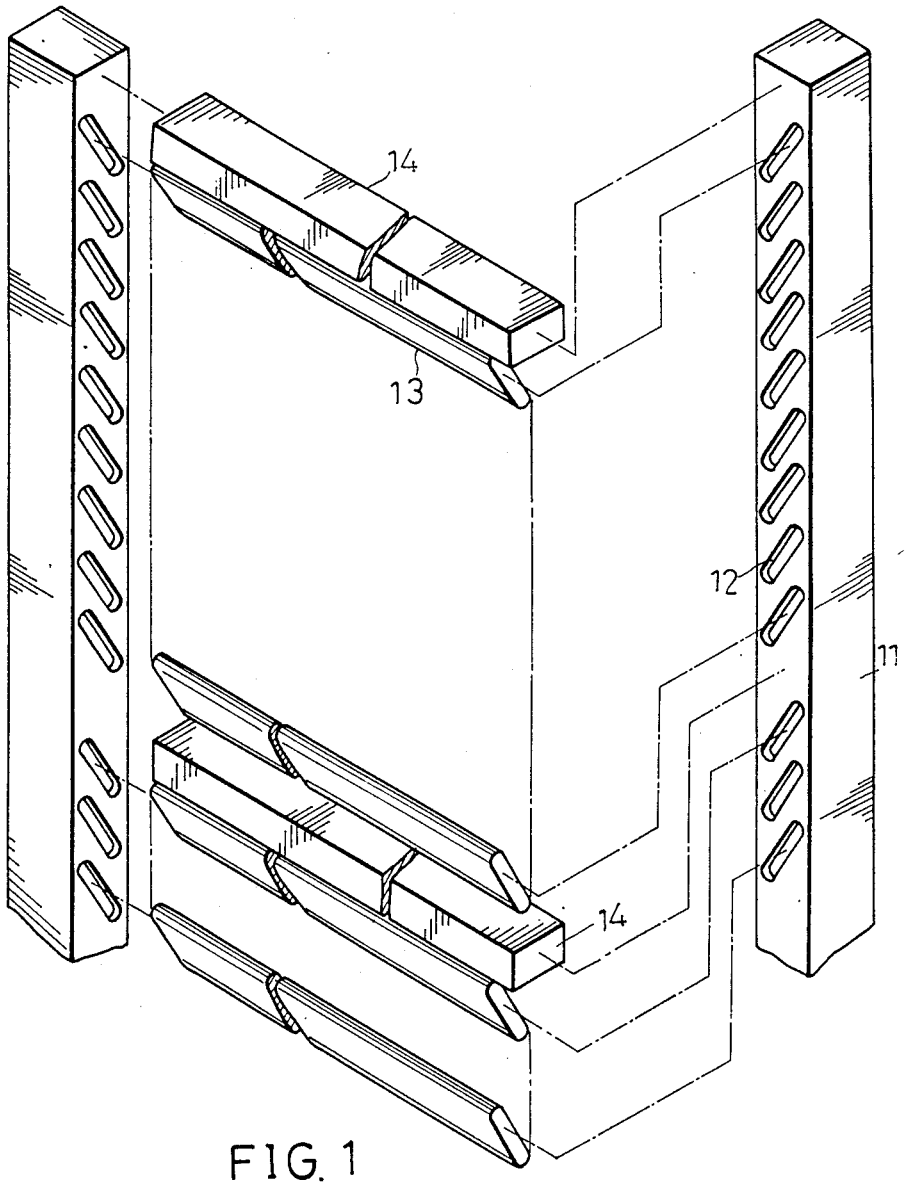
FIG. 1 (PRIOR ART)
FIG. 1 is an exploded and perspective view of the known modular construction unit to be combined as a partitioned screen or a door plate.
Figure 2:
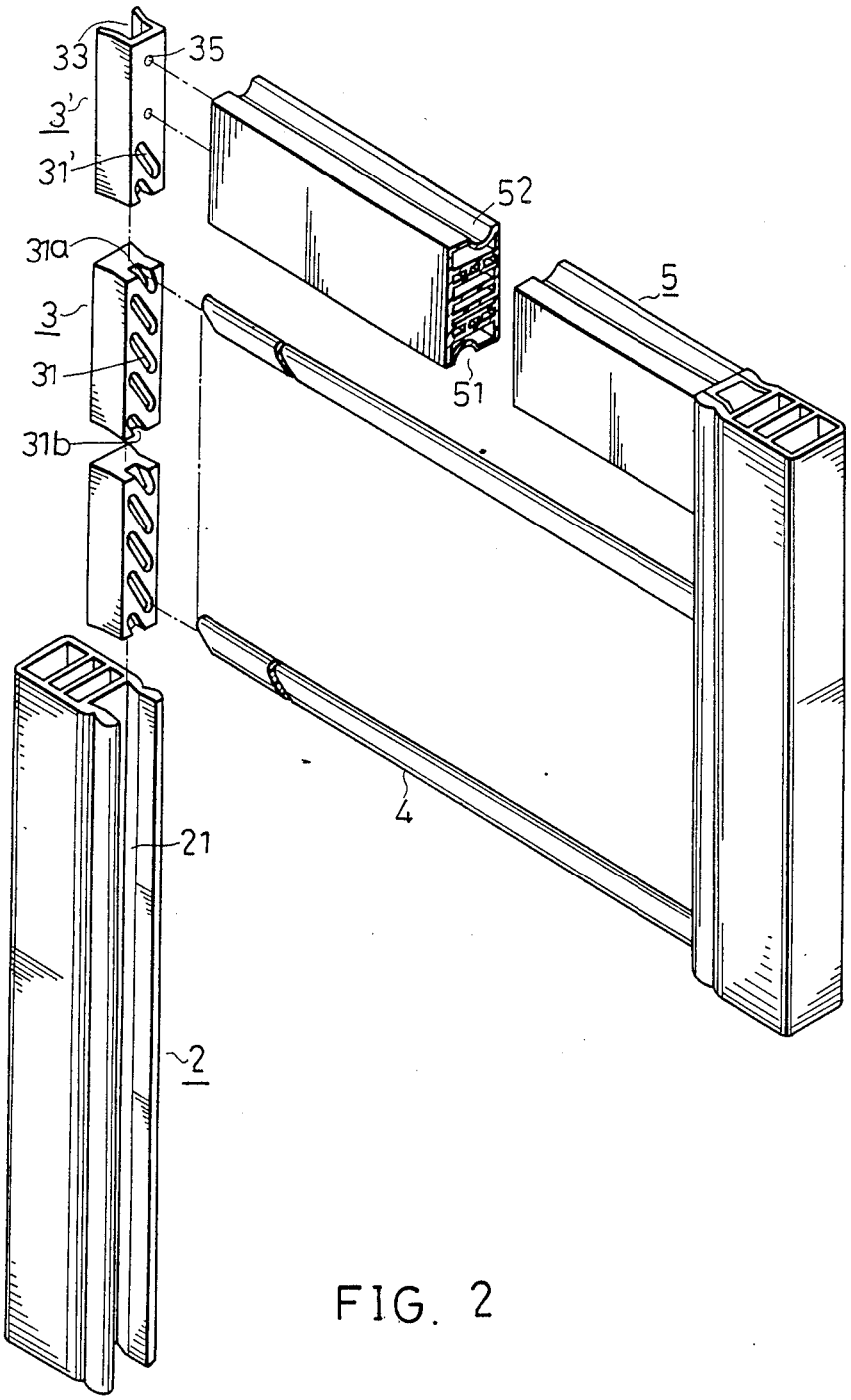
FIG. 2 is an exploded and perspective view of a preferred embodiment of a modular construction unit according to the present invention.

Referring to FIGS. 2, 3, 4 and 5, the preferred embodiment of a modular construction unit according to the present invention comprises a plurality of supporting columns 2, a plurality of scarfing blocks 3 and junction blocks 3', a plurality of scarfing members 4, and a plurality of intermediate beams 5. The supporting columns 2 can be made of polyvinyl chloride (PVC) material with the outer surface thereof being prepared in a simulated streaked wood color, each one of them including a U-shaped open trough 21 with a wider bottom side and a narrower upper portion vertically formed on one side. In combination, a pair of supporting columns 2 usually must be positioned one opposite the other. Each one of the scarfing blocks 3, which can be made in different lengths, as shown in combination in FIG. 4, has a wider side being formed in conjunction with the U-shaped open trough 21 of the supporting columns 2 and a narrower side having a plurality of scarfing slots 31 provided therein, including an upper end slot **31*a* and a lower end slot 31*b*. (It is to be noted that, when the scarfing blocks 3 are inserted into the open trough 21 of both supporting columns 2, the insertion direction of the scarfing blocks 3 inserted into the open trough 21 of one supporting column 2 must be in inverse relation to that of the scarfing blocks 3 inserted into the open trough 21 of the other supporting column 2 (i.e. the upper ends of the scarfing blocks 3 in one supporting column 2 are the lower ends of the scarfing blocks in the other supporting column 2). The scarfing member 4 can be shaped in accordance with the formation of the scarfing slots 31. As shown in FIG. 2, the scarfing members 4 are formed to make a combination of a partitioning screen in which air ventilation can be achieved through the space defined between each of the two adjacent scarfing members 4. Each of the junction blocks 3' includes a U-shaped open section 33 formed in the back side in conjunction with the U-shaped open trough 21 of the supporting columns 2, a plurality of threaded holes 35 and scarfing slots 31' formed in the front side. (It shall be appreciated that the location and slanting direction of the scarfing slots 31 in some scarfing blocks 3 may be different from that of other scarfing blocks 3 as this is necessary for making various patterns of assembly.) The intermediate beams 5 are also made of PVC material of a color and streaking similar to that of the supporting columns 2. Each of said beams includes: an upper groove 52; a lower groove 51; and screw holes 35***a* provided at both ends in conjunction with the threaded holes 35 of the junction blocks 3'. These intermediate beams 5 can be optionally connected between the two supporting columns 2 at the lower, middle and upper portions thereof through the junction blocks 3', which are separately screwed at both ends of the intermediate beams 5 through the threaded holes 35 before being inserted into the open trough 21 of the supporting columns 2.

Figure 3:
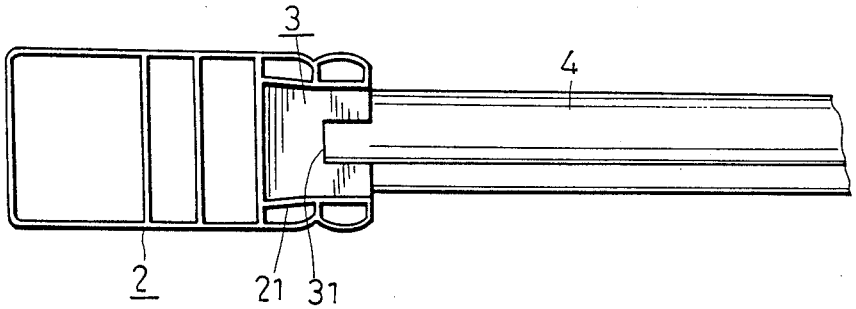
FIG. 3 is an illustration of a partial combination of the preferred embodiment.
Figure 4:
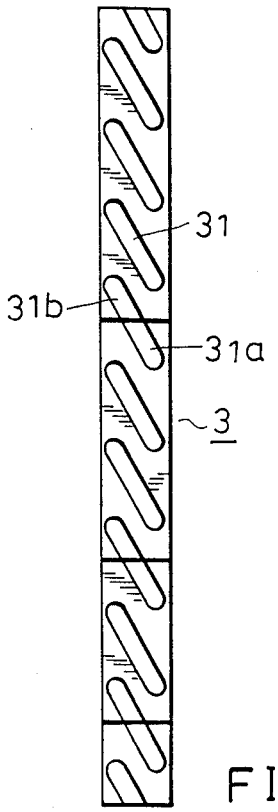
FIG. 4 is a front plan view of a supporting column combined with scarfing blocks of different lengths.

With different lengths of scarfing blocks, such as the scarfing block 3 depicted in FIG. 3, different lengths of the scarfing blocks 3, various height combinations of the supporting columns 2 can be made as required. It shall be appreciated that, regardless of the lengths of the scarfing blocks 3, the spacing between the scarfing slots 31 is uniform, and the upper end slot 31*a* and lower end slot 31*b* of the adjacent two scarfing blocks 3 are in complete alignment, forming an integral scarfing slot.

Figures 5, 8:
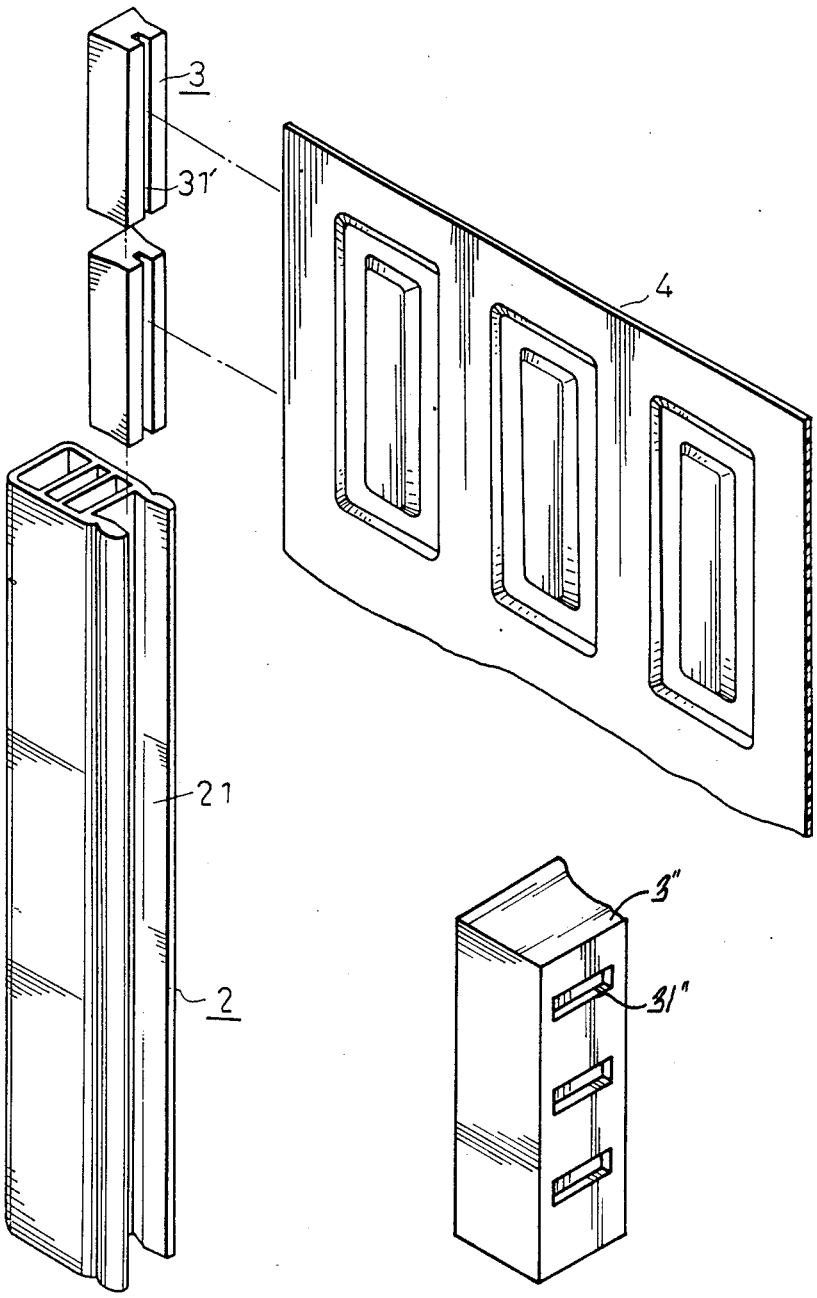
FIG. 5 is an exploded and perspective view of the preferred embodiment with an alternative example of the scarfing means formed in the scarfing blocks and matched with alternative scarfing members according to the present invention.
FIG. 8 represents an alternative scarfing means formed in the scarfing block with horizontal scarfing members according to the present invention.
Figure 7:
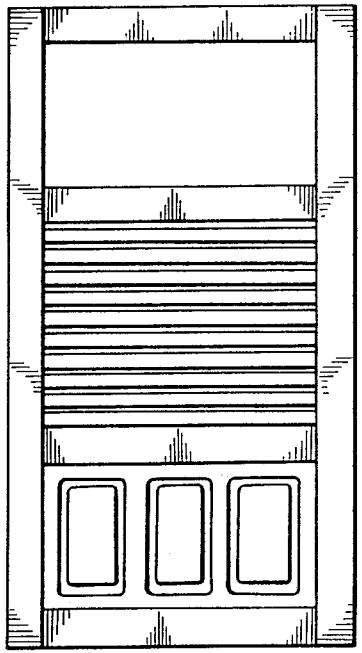
FIGS. 6 and 7 are representations of the preferred embodiment showing different possible assemblies.
Figure 6:
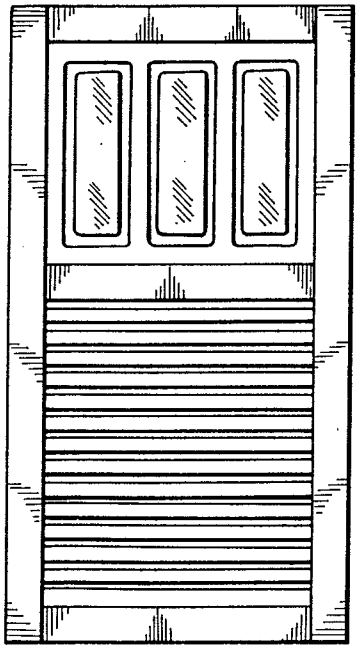

As shown in FIG. 5 with reference to FIGS. 6 and 7, the scarfing slot 31 of each of the scarfing blocks 3 is a single slot vertically formed in the central area, and the scarfing member 4 can be in the form of an artistic plate in conjunction with the vertical single slot 31. In combination, various scarfing blocks 3 with different scarfing slots 31 can be alternatively disposed in the U-shaped open trough 21 of the supporting column 2 so as to form different assembly patterns as respectively shown in FIGS. 6 and 7. It shall be appreciated that, in addition to the slant scarfing slots 31 and vertical scarfing slots 31' as respectively shown in FIGS. 2 and 5, other kinds of scarfing slots, (horizontal, round, etc.), may also be formed to match with other kinds of scarfing members 4, (such as those formed in round, square, etc. shapes), for making varying combinations therewith. Moreover, a plurality of hinges can be installed at a backside of one supporting column and then movably fixed on a door post to serve as a screen door.

The main feature of the present invention is the scarfing blocks 3 formed with different scarfing means 31 and the scarfing members 4 provided in different shapes so that with the different scarfing blocks 3 alternatively disposed in the U-shaped open trough 21 of the supporting columns 2, a wide variety of assembly patterns can be made as required without changing the supporting columns 2.

The foregoing is considered as illustrative only of the principles of the present invention. Furthermore, since numerous modifications and changes will readily occur to those skilled in the art, it is not desired to limit the invention to the exact construction and operation shown and described. Accordingly, all possible and suitable modifications and equivalents may be resorted to fall within the scope of the present invention as claimed.

What is claimed is:

1. A modular construction unit comprising:

a plurality of supporting means each being formed as a column and each being provided with a U-shaped vertical open trough on one side, said U-shaped vertical open trough including a wider bottom side and a narrower upper portion;

a plurality of scarfing blocks, each being of sufficient width to releasably engage said U-shaped vertical open trough of said supporting means, said scarfing blocks being provided with scarfing means on one side and having said scarfing means facing outward for making combinations therewith when said scarfing blocks are inserted into said U-shaped vertical open trough of said supporting means;

a plurality of junction blocks, each being of sufficient width to releasably engage said U-shaped vertical open trough, said plurality of junction blocks being provided with at least one threaded hole and scarfing means on one side for making connections therewith;

a plurality of scarfing members, each being of sufficient width to be formed detachably secured in said scarfing means between two of said scarfing blocks and symmetrically inserted into said U-shaped vertical open troughs of said supporting means; and a plurality of intermediate beams, each being formed with an upper open groove and a lower open groove of sufficient width to releasably engage said scarfing members, and each end of said intermediate beams being provided with at least one screw opening for being connected to one of said junction blocks, said junction blocks being inserted into respective U-shaped vertical open troughs of said supporting means, wherein at least two of said plurality of junction blocks being positioned in opposite directions.

2. A modular construction unit according to claim 1 wherein said scarfing blocks are formed in different lengths so as to make assemblies of different heights therewith.

3. A modular construction unit according to claim 1 wherein said scarfing blocks and scarfing means comprise a plurality of uniformly spaced scarfing slots formed slantwise on one side of said scarfing blocks.

4. A modular construction unit according to claim 3 wherein said scarfing blocks further include an upper end slot and a lower end slot formed on one side of each one of said scarfing blocks so that when said scarfing blocks are inserted into said U-shaped vertical open trough of said supporting means, said upper end slot and said lower end slot of one of said scarfing blocks will be aligned with the lower end slot and the upper end slot of other adjacent scarfing blocks.

5. A modular construction unit according to claim 1 wherein said scarfing blocks and scarfing means further comprise a single slot vertically formed in a central area on one side of each said scarfing blocks for making various assembly patterns therewith.

6. A modular construction unit according to claim 1 wherein said scarfing blocks and scarfing means further comprise a plurality of scarfing slots horizontally formed in one side of each said scarfing blocks.

* * * * *